US006885751B2

(12) United States Patent
Pribyl

(10) Patent No.: US 6,885,751 B2
(45) Date of Patent: Apr. 26, 2005

(54) PRESSURE-GRADIENT MICROPHONE CAPSULE

(75) Inventor: Richard Pribyl, Fischamend (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 10/374,660

(22) Filed: Feb. 26, 2003

(65) Prior Publication Data

US 2003/0165251 A1 Sep. 4, 2003

(30) Foreign Application Priority Data

Feb. 26, 2002 (AT) ..... A 290/2002

(51) Int. Cl.[7] ..... H04R 25/00

(52) U.S. Cl. ..... 381/174; 381/355; 381/357; 381/361

(58) Field of Search ..... 381/355, 356, 381/357, 358, 360, 174, 191, 113, 361, 313

(56) References Cited

U.S. PATENT DOCUMENTS 4,850,016 A * 7/1989 Groves et al. ..... 381/356
5,226,076 A 7/1993 Baumhauer et al.
6,148,089 A * 11/2000 Akinno ..... 381/356

* cited by examiner

*Primary Examiner*—Huyen D. Le
(74) *Attorney, Agent, or Firm*—Friedrich Kueffner

(57) ABSTRACT

An electrostatic pressure-gradient microphone capsule to be mounted essentially flush in or behind especially flat mounting surfaces includes a capsule housing with two sound inlet openings which may be divided, a diaphragm tightly mounted on a diaphragm ring, an electrode and possibly an acoustic friction. The two sound entry openings are arranged on one side of the capsule housing, i.e., the front side, and one sound entry opening is connected acoustically conductively with the front side of the diaphragm and the other sound entry opening is connected acoustically conductively with the rear side of the diaphragm, and the diaphragm is arranged essentially parallel to the front side.

5 Claims, 3 Drawing Sheets

PRESSURE-GRADIENT MICROPHONE CAPSULE

BACKGROUND OF THE INVENTION

1. Field of the Invention

The present invention relates to an electrostatic pressure-gradient microphone capsule to be mounted essentially flush in or behind especially flat mounting surfaces. The microphone capsule includes a capsule housing with two sound inlet openings which may be divided, a diaphragm tightly mounted on a diaphragm ring, an electrode and possibly an acoustic friction.

2. Description of the Related Art

Independently of their physical manner of operation, electrostatic transducers for microphones have a diaphragm which is subjected to the field of sound and is excited to vibrations by the field of sound. Consequently, the invention is directed to an electrostatic microphone.

The electrodes of the electrostatic transducer are an elastic, tightly mounted diaphragm and a rigid electrode which is usually just called electrode. Both electrodes form a capacitor whose electrical capacity changes as a result of pressure variations of the field of sound. Since an electrical field is built up between the electrodes of the electrostatic transducer, it is possible to transpose the capacity changes of the transducer into electrical voltage changes by means of a subsequently connected amplifier.

The electroacoustic properties of electrostatic microphone capsules are primarily dependent on the type of the acoustic excitation of the diaphragm. Known in the art are the so called pressure receivers, on the one hand, and the so called pressure-gradient receivers, on the other hand. The diaphragm of the first type is subjected to the field of sound only in one direction, i.e., the so called front direction; consequently, they react only to the changes of the air pressure due to the sound waves. Since the air pressure is a scalar quantity, microphones constructed in this manner have a spherical directional effect. In a pressure-gradient receiver, the diaphragm is subjected to the field of sound from both directions; consequently, the diaphragm is excited to movement by the pressure gradient prevailing at any given time between the front and rear sides of the diaphragm. Because of the travel time differences of the sound waves to the front side and the rear side, microphones constructed in this manner have a directional characteristic which, with a correct acoustic adjustment of the microphone capsule, may have any selected shape between an 8-shaped and kidney-shaped directional characteristic.

In the past, pressure-gradient microphone capsules were constructed in such a way that the front and rear sides of the diaphragm were arranged so as to coincide with the front and rear sound openings. This means that such microphone capsules have an axially symmetrical directional characteristic. FIG. 1 shows an electrostatic microphone capsule in accordance with the prior art. The capsule has a, front sound entry opening 21 and a rear sound entry opening 22.

It is now required more and more often that microphone capsules are mounted as much as possible flush in a flat and relatively large surface. This may be the roof of an automobile if a hands-free device for a mobile telephone or other communication device is to be provided in the automobile. However, microphone capsules according to the prior art are not capable of meeting this requirements and it is very difficult, expensive and technically cumbersome to mount the microphones in a flat surface. FIG. 2 of the drawing shows the usual mounting situation according to the prior art for a microphone capsule operating in accordance with the electrostatic principle. In order to make both sound entry openings accessible to the sound as it is required for the operation of the capsule, it is necessary to mount the capsule above the mounting surface, and not in the mounting surface as it is desired.

U.S. Pat. No. 5,226,076 A discloses mounting a capsule as illustrated in FIG. 2 in a housing which has two sound openings at one of its longitudinal walls, wherein one sound opening each is arranged on both sides of the capsule. This makes it possible to mount the housing in or behind a flat mounting surface. However, this solution has the disadvantage that it has a great structural height or depth because the axis of symmetry of the capsule extends parallel to the mounting plane and, therefore, the capsule has a high structural height. In addition, the assembly of the microphone including the capsule with its housing is complicated and expensive because the housing essentially is an added component which is completely separate from the finished microphone.

Because of the nature of a pressure receiver, microphone capsules with only one sound entry operating according to the principle of the pressure receiver can be integrated without problems in the mounting surface. However, since they have a spherical directional characteristic, it is then not possible to utilize the significant advantages of the directional characteristic. Because of their spherical directional characteristic, the pressure receivers are equally sensitive to useful sound and to interfering sound. Consequently, they are usually not used in a loud environment.

SUMMARY OF THE INVENTION

Therefore, it is the primary object of the present invention to provide a microphone capsule which operates according to the electrostatic principle and is constructed as an electroacoustic transducer according to the pressure-gradient principle, wherein the microphone capsule can also be integrated into a flat surface without optical interferences or acoustic compromises, and wherein the microphone capsule has a low structural height and is simple and inexpensive to manufacture.

In accordance with the present invention, the two sound entry openings are arranged on one side of the capsule housing, i.e., the front side, and one sound entry opening is connected acoustically conductively with the front side of the diaphragm and the other sound entry opening is connected acoustically conductively with the rear side of the diaphragm, and the diaphragm is arranged essentially parallel to the front side.

By rotating the plane in which the diaphragm is located and by constructing the capsule with the acoustic connections between the respective sound entry opening and the corresponding side of the diaphragm, two significant advantages are achieved as compared to the U.S. Patent mentioned above. It is now possible to omit the housing and the structural height is significantly reduced. In accordance with a further development, it is even possible to omit the acoustic friction, which further reduces the costs and volume.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
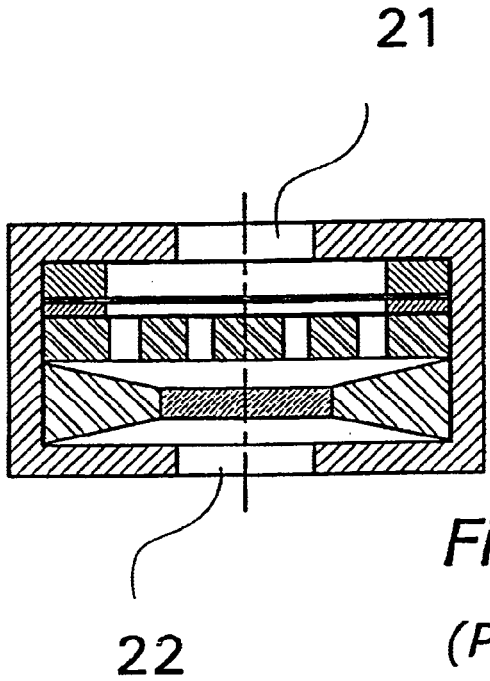
Fig. 1 (Prior Art)
FIG. 1 is a sectional view of a pressure-gradient capsule according to the prior art.
Figure 2:
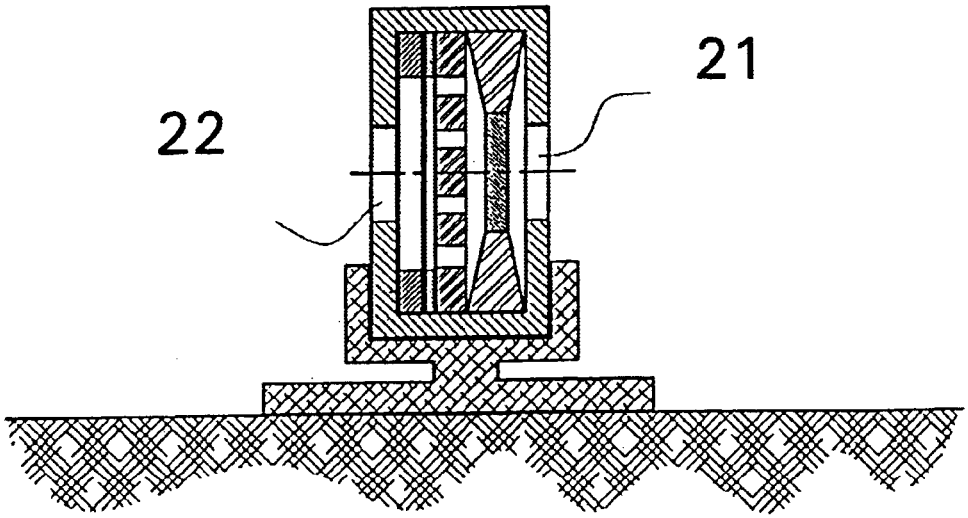
Fig. 2 (Prior Art)
FIG. 2 is a sectional view illustrating the manner of mounting the capsule according to FIG. 1.
Figure 3:
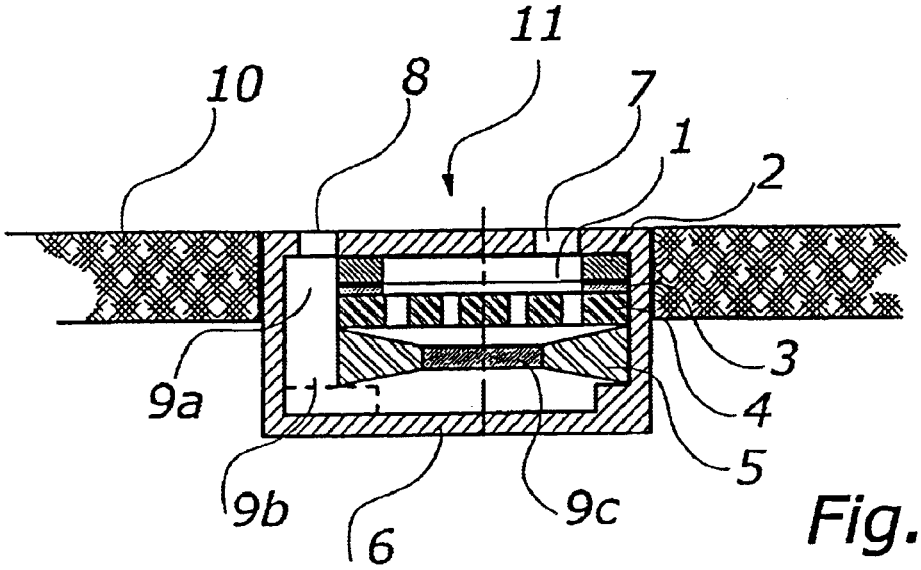
FIG. 3 is a sectional view of a pressure-gradient capsule according to the present invention shown in the mounted state.

As illustrated in FIG. 3, a pressure-gradient capsule according to the present invention is essentially constructed as follows: a diaphragm 1 is tightly mounted and glued onto a diaphragm ring 2. The diaphragm 1 is mounted by means of a spacer ring 3 so as to be distanced from an electrode 4 by about 10 to 60 $\mu$m. The diaphragm 1 and the electrode 4 together form a capacitor. The electrode 4 is provided with bores. On the side of the electrode facing away from the diaphragm 1, a so called acoustic friction 5 is provided. The acoustic friction 5 usually is a plastic ring whose opening is covered by a porous material, such as metal screen fabric, sinter material, plastic fabric or natural fiber. The purpose of the acoustic friction 5 is to acoustically adjust the microphone capsule. In principle, this configuration is known in the art.

In accordance with the present invention, the capsule is mounted in a capsule housing 6. The capsule housing 6 is closed on its upper side, i.e., the front side 11, with a cover. The front side 11 has at least two sound openings, wherein one opening, i.e., the front opening 7, permits entry of the sound waves to the front side of the diaphragm 1, and the second opening, i.e., the rear opening 8, permits entry of the sound waves to the rear side of the diaphragm 1 through a sound duct 9 composed of portions of sections 9*a*, 9*b* and 9*c*, which extends past the components of the capsule. The sound duct 9 may replace or supplement the acoustic friction 5 as indicated in the section 9*c*; a separate sound friction may also be arranged in the interior of the sound duct 9, for example, in the section 9*b*. Such acoustic frictions may be arranged in the sound duct 9 either at the beginning thereof, near the rear opening 8, or in its sections, or also in the entire area of the sound duct.

Consequently, the objects of the present invention are achieved in that the capsule has in planes extending parallel to the diaphragm 1 a greater cross-section than the diaphragm ring 2, and that the remaining surface is utilized for arranging within the capsule a sound duct, namely the sound duct 9*a*, 9*b*, 9*c* which extends "around the diaphragm" toward the rear side of the unit composed of diaphragm and electrode. Since the diameter of the diaphragm ring 2 is significantly greater than the height of the unit composed of diaphragm and electrode including rings and friction, the invention makes it possible to manufacture pressure-gradient microphones which have a much lower structural height, wherein this can be achieved with significantly lower manufacturing costs because the assembly can be carried out in a single step on the same machines as in the past because only the capsule housing has a slightly different shape.

Because of the configuration according to the present invention, the microphone capsule can be mounted in such a way that the surface of the capsule housing 6 is flush with the mounting surface 10 and, therefore, is optically almost unnoticeable. The capsule is mounted directionally, so that the front opening 7 of the sound source to be picked up is closer than the rear opening 8. The microphone capsule is adjusted acoustically in such a way that its directional characteristic has its maximum sensitivity in the expected direction of the speaker. This makes it possible to position the directional characteristic parallel to the mounting plane 10, so that interfering signals from other directions can be tuned out.

FIG. 3 does not show the manner of mounting the capsule in detail. The capsule may be mounted by means of a press fit, by gluing, by means of screws, bolts, etc. so as to be releasably or fixedly connected to the mounting surface. The electrical contacts are also not illustrated; this does not pose any difficulties to those skilled in the art when aware of the invention. Depending on whether a friction 5 is provided or not, the structural height can be further reduced.

In the cross-section normal to the diaphragm plane, the capsule housing may be oval or of two semicircles with a rectangular central part, so that the circular components of the actual transducer are supported over a significant portion of the circumference. When a different shape is selected, it is also possible to connect these components separately and to mount them together in the capsule housing; however, this is advisable only in special cases because of the large space requirements and the more cumbersome assembly.

FIG. 3 also does not illustrate in detail the support or mounting of the actual structural components, i.e., the friction, the electrode and the diaphragm ring. The components may be supported by a shoulder or several bracket-like structures which protrude inwardly from the inner surface of the capsule housing 6, wherein the components are constructed so as to be cantilevered in the areas adjacent to the sound duct 9. It is also possible to provide knobs, webs, raised portions or the like which extend upwardly from the bottom of the capsule housing 6, as indicated schematically in the section 9*b* of the sound duct 9 which support the friction or the electrode.

Figure 4:
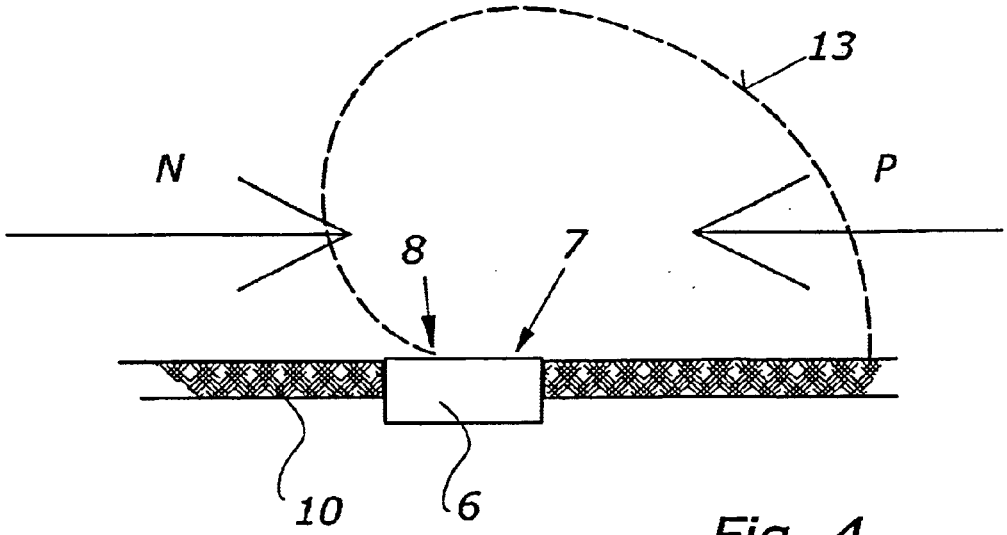
FIG. 4 is an illustration of a directional characteristic which can be achieved with the capsule of FIG. 3.

FIG. 4 of the drawing shows a directional characteristic, indicated by a broken line 13, which can be achieved with the transducer according to the present invention. A transducer constructed according to the invention is mounted with its capsule housing 6 so as to be flush with the mounting surface 10, wherein the centers of the two sound entry openings 7, 8, only schematically illustrated, are located in the plane of the drawing. The arrow P essentially indicates the direction in which the sensitivity of the mounted microphone is the greatest. For example, if this corresponds to the direction toward the head of the driver of an automobile in which the transducer is mounted, it is readily apparent that the microphone transmits very little sound from the direction of the passenger, indicated by arrow N, from where the most interfering noises would originate; this is the case even though the capsule is mounted flush and optically hardly visible behind the mounting surface 10.

Of course, it is possible to perforate the mounting surface 10 only where the sound entry openings 7, 8 are located, or to open up the mounting surface 10 in some other manner, and to mount the capsule completely behind the material of the mounting surface 10. This must be taken into consideration when selecting the dimensions of the capsule and the acoustic friction, however, this does not pose any difficulties for those skilled in the art of acoustics when aware of the invention.

All materials which are used for manufacturing conventional electroacoustic transducers can be used for the invention; also, processing and assembly can be carried out using conventional techniques.

The invention is not limited by the embodiments described above which are presented as examples only but can be modified in various ways within the scope of protection defined by the appended patent claims.

I claim:

1. An electrostatic pressure-gradient microphone capsule adapted to be mounted essentially flush in or behind mounting surfaces, the microphone capsule comprising a capsule housing with first and second sound entry openings, a diaphragm tightly mounted on a diaphragm ring, and an electrode, wherein the capsule housing has a front side and a rear side, wherein the first and second sound entry openings are arranged on the front side of the capsule housing, wherein the first sound entry opening is acoustically conductively connected to a front side of the diaphragm and the second sound entry opening is acoustically conductively connected to a rear side of the diaphragm, and wherein the diaphragm has a plane extending at least essentially parallel to the mounting surface, and further comprising an acoustic friction on a side of the electrode facing away from the diaphragm.

2. The microphone capsule according to claim 1, wherein the acoustically conductive connection between the rear side of the diaphragm and the second sound entry opening is a sound duct extending in an interior of the capsule housing.

3. An electrostatic pressure-gradient microphone capsule adapted to be mounted essentially flush in or behind mounting surfaces, the microphone capsule comprising a capsule housing with first and second sound entry openings, a diaphragm tightly mounted on a diaphragm ring, and an electrode, wherein the capsule housing has a front side and a rear side, wherein the first and second sound entry openings are arranged on the front side of the capsule housing, wherein the first sound entry opening is acoustically conductively connected to a front side of the diaphragm and the second sound entry opening is acoustically conductively connected to a rear side of the diaphragm, and wherein the diaphragm has a plane extending at least essentially parallel to the mounting surface, further comprising an acoustic friction on a side of the electrode facing away from the diaphragm, wherein the acoustically conductive connection between the rear side of the diaphragm and the second sound entry opening is a sound duct extending in an interior of the capsule housing, and further comprising projecting members in the interior of the capsule housing for supporting the diaphragm ring and the electrode.

4. The microphone capsule according to claim 3, wherein the sound duct is composed of a free space between an inner surface of the capsule housing and outer surfaces of the diaphragm ring and the electrode.

5. The microphone capsule according to claim 3, further comprising an acoustic friction in the sound duct.

* * * * *